United States Patent [19]

Hollis et al.

[11] Patent Number: 4,882,678

[45] Date of Patent: Nov. 21, 1989

[54] DATA SENSING AND PROCESSING DEVICE FOR SCUBA DIVERS

[75] Inventors: Robert Hollis, San Leandro; John E. Lewis, Rancho Palos Verdes; Marvin Ackerman, Sunnyvale, all of Calif.

[73] Assignee: Oceanic USA, San Leandro, Calif.

[21] Appl. No.: 3,085

[22] Filed: Jan. 14, 1987

[51] Int. Cl.[4] ..... G06G 7/60

[52] U.S. Cl. ..... 364/413.31; 73/865.1; 128/204.23

[58] Field of Search ..... 364/418, 558, 803, 413.31; 728/204.23, 205.23; 73/432.1, 865.1

[56] References Cited

U.S. PATENT DOCUMENTS

| | | | |
|---|---|---|---|
| 4,005,282 | 1/1977 | Jennings | 364/418 |
| 4,054,783 | 10/1977 | Seireg et al. | 364/418 |
| 4,109,140 | 8/1928 | Etra | 73/865.1 |
| 4,188,825 | 2/1980 | Farrar | 73/865.1 |
| 4,192,001 | 3/1980 | Villa | 364/418 |
| 4,586,136 | 4/1986 | Lewis | 128/204.23 |
| 4,658,358 | 4/1987 | Leach et al. | 364/413.31 |
| 4,782,338 | 11/1988 | Barshinger | 364/413.31 |

*Primary Examiner*—Jerry Smith
*Assistant Examiner*—Kimthanh T. Bui
*Attorney, Agent, or Firm*—Bruce & McCoy

[57] ABSTRACT

A portable data sensing and processing device for a SCUBA diver using a tank of compressed air wherein the device provides integrated information to the diver on a liquid crystal display screen to permit the diver to make a longer time variable depth underwater dive than would be permitted by the U.S. Navy dive tables for a no-decompression ascent.

4 Claims, 3 Drawing Sheets

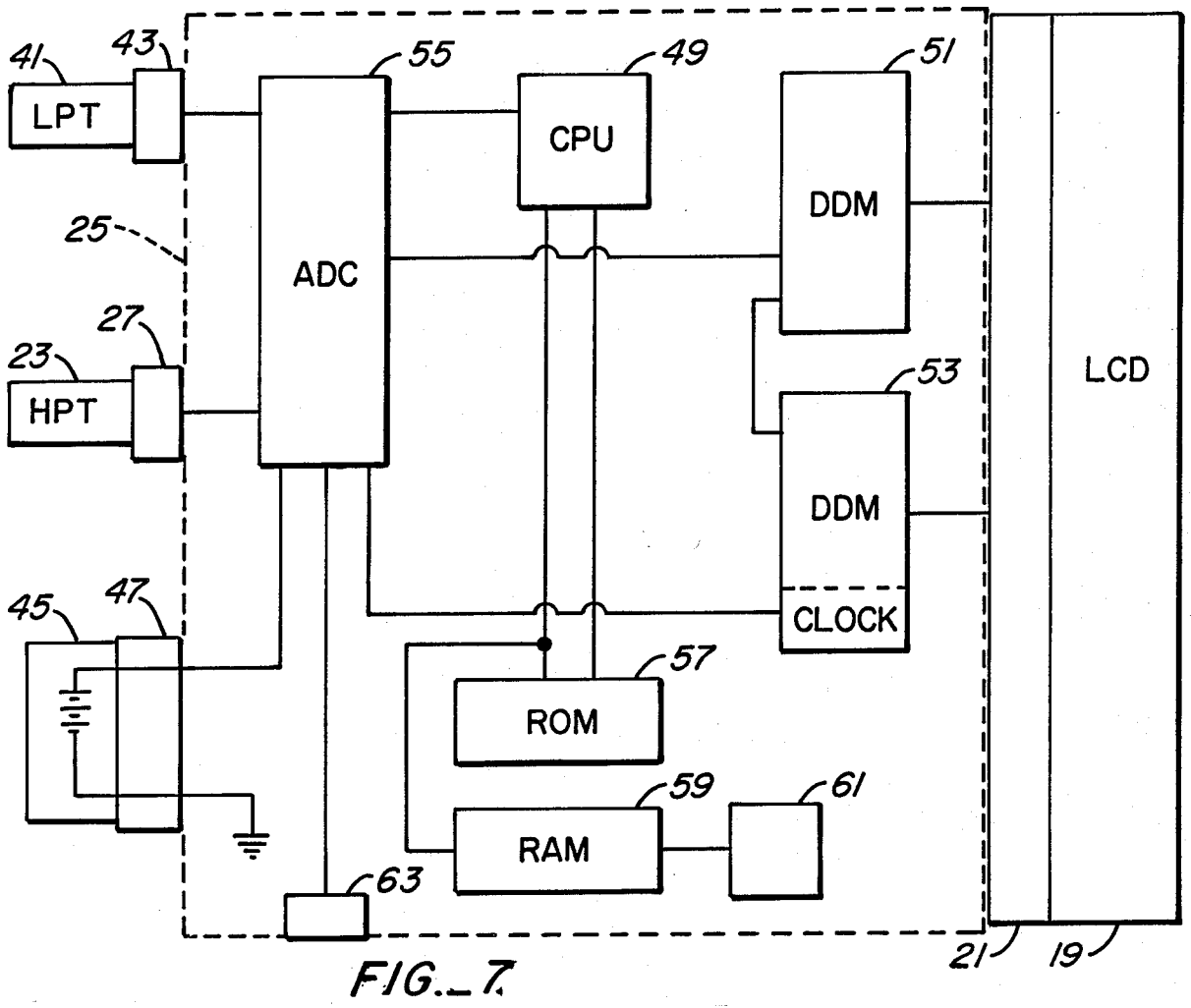
FIG._7.
FIG._8.
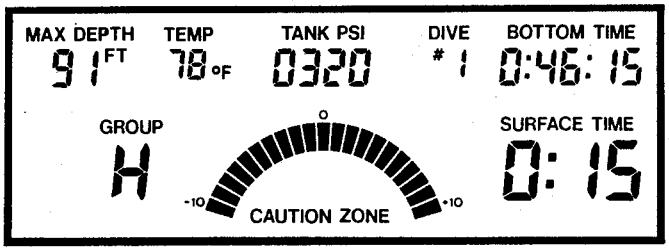
FIG._9.
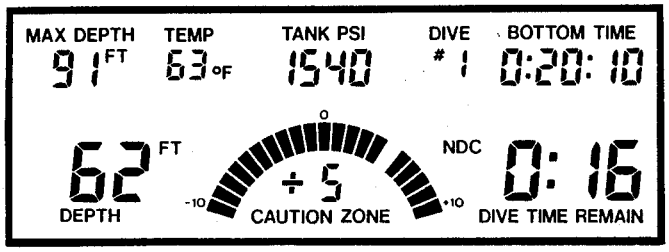

DATA SENSING AND PROCESSING DEVICE FOR SCUBA DIVERS

BACKGROUND OF THE INVENTION

1. FIELD OF THE INVENTION

The present invention relates to data sensing and processing devices for SCUBA divers and more particularly to a portable underwater computer for a SCUBA diver using a tank of compressed air wherein the instrument measures several variables and provides integrated information to the diver numerically and graphically to permit the diver to make a variable depth dive with the longest time underwater allowing for a no-decompression ascent.

2. DESCRIPTION OF THE PRIOR ART

One of the primary problems for an underwater diver to avoid is "decompression sickness" commonly known as the "bends". This condition results from tissue saturation with the inert gas components of air (basically nitrogen). It has been fully studied, and procedures for avoiding it have been set forth in the writings by Boycott, Damant, and Haldane (1908), further developed by Behnke (1942), Hempelman (1952), Roshbash (1954), and Workman (1965). The principal method now used to prevent the condition after saturation occurs is a series of decompression pauses during the diver's resurfacing ascent. This allows time for out-gassing of the excess inert gases which have accumulated in the body issues. Schedules of these resurfacing pauses have been developed by the U.S. Navy from the work of the previously mentioned investigators.

Many gauges and computers have been designed for the purpose of aiding a SCUBA (self-contained underwater breathing apparatus) diver during a decompression ascent to avoid the bends. Probably the earliest and most comprehensive complex gauge is described in U.S. Pat. No. 3,457,393 to Stubbs and Kidd for an Analog Decompression Computing Device issued Jul. 22, 1969. This device employs mechanical gauges and sensors to gather and integrate data, for simulating the absorption of the inert gas component of air at changing pressures on human tissues, to assist a diver through decompression.

A subsequent device for computing a diver's decompression schedule is disclosed in U.S. Pat. No. 3,681,585 to Todd which issued Aug. 1, 1972. This device is basically an electronic device rather than mechanical as disclosed in the Stubbs and Kidd patent.

In the Sept. 1975 issue of *Canadian Electronics Engineering*, R. K. Lomnes described an electronic data processing device for SCUBA divers designed to prevent decompression sickness. The article was entitled "Microcomputers Applied to Underwater Diving" and the device disclosed in that article had the following features: the hardware included a real time (crystal-controlled) clock; an external analog pressure transducer; a digital to analog convertor; digital electronics; RAM and PROM memory; a microprocessor; a digital numeric liquid crystal display screen (LCD); and it was battery operated. This data processor permitted predive planning; on-line dive monitoring; it used the Kidd-Stubbs four-tissue model for gas absorption; it displayed depth, total dive time, safe ascent depth, ascent time, and low battery indication. In addition, it was programmable to provide additional information to the diver. While the decompression calculator described in the article was a desktop device, an explicit reference was made to the future development of portable units for sports divers.

Subsequent to publication of the 1975 article, U.S. Pat. No. 4,192,001 was issued to Francesco Villa on Mar. 4, 1980, for A DECOMPRESSION ASCENT COMPUTER, which was essentially no different than the computer described in the 1975 article. Additional computers for use by SCUBA divers are disclosed in U.S. Pat. No. 3,992,948 to D' Antonio, et al. for DIVER INFORMATION SYSTEM, issued Nov. 23, 1976; U.S. Pat. No. 4,005,282 to Jennings for a DECOMETER issued Jan. 25, 1977; U.S. Pat. No. 4,054,783 to Seireg et al. for DECOMPRESSION PLAN DEVICE issued Oct. 18, 1977; and U.S. Pat. No. 4,109,140 to Etra for DIVER'S CONTROL AND INDICATION APPARATUS issued Aug. 22, 1978. None of these patents appear to teach anything novel over the 1975 article.

The purpose of each of the above-described computer devices is to aid a diver during decompression, i.e. during the period after they have exceeded the underwater time for a safe ascent without decompression.

One of the most serious concerns of a sport diver is to avoid the condition, caused by a combination of the time and depth he has been underwater, which requires a decompression ascent schedule for resurfacing. An important consideration for aiding a diver to avoid the problem is to present the complex information in a simple display rather than in numerical format which requires further interpretation or computation by the diver. Therefore, the present invention provides a computer which will integrate different sums of information and present it in a graphic display to aid a SCUBA diver in avoiding the necessity of a decompression ascent schedule.

The present invention is not a decompression meter as described by the previously referenced prior art. The invention continuously monitors air tank pressure, hydrostatic pressure, underwater time, and integrates that information between two formulas, using a different decompression model, to provide a graphic display which permits the SCUBA diver to avoid a decompression condition and monitor how close he comes to such a condition. It gives the diver all the information he needs to plan his dive, maintain a safe air reserve, and dive within the no-decompression limits accepted by the U.S. Navy.

SUMMARY OF THE INVENTION

The present invention is a portable data sensor, processor, and display for a SCUBA diver using a tank of compressed air. The processor includes means for measuring the air pressure in the tank, means for measuring the ambient hydrostatic pressure or water depth, and means for measuring real time. A first simulating means is provided which is responsive to the three measuring means for predicting the dive time remaining at depth that provides for an air reserve following a direct ascent to the surface. A second simulating means is provided which is responsive to the three measuring means for predicting the dive time remaining at depth that provides for a direct ascent to the surface without the need for decompression stops. A selection means is also provided for determining the allowable remaining dive time which is the lesser of the two dive remaining times predicted by the first and second simulating means. And finally a means is provided for displaying a warning, both graphically and numerically, as to how close the diver is approaching a need for decompression.

The present invention also includes a pre-dive planning feature which has a third simulating means for predicting prior to a dive the maximum allowable dive time at a variety of depths to avoid running out of air or a decompression ascent and means for displaying that information prior to a dive.

The present invention further includes a measure of decompression status which includes a means for monitoring the minimum no-decompression (NDC) dive time that occurred during a dive and means for monitoring the holding time spent at a depth of approximately 10 feet following a dive, and means for adding the holding time to the minimum no-decompression dive time that occurred during a dive, and means for displaying the sum of said times.

The present invention still further includes means for replicating the complete repetitive dive schedules contained in the U.S. Navy Diving Manual, and means for comparing the actual dive profile with said schedules, and means for displaying the repetitive dive group status prior to a dive.

The present invention includes memory means for recording dive profiles and violation of no-decompression dive limits for subsequent recall. It also includes safety shutdowns for de-activating the device after violations of the no-decompression limits occur.

OBJECTS OF THE INVENTION

It is therefore an important object of the present invention to provide a data sensor, processor, and display for a SCUBA diver which monitors air tank pressure and calculates remaining air time at depth and provides for consumption during ascent and for an air reserve upon surfacing.

It is another object of the present invention to provide a device that uses a proven decompression model to calculate remaining dive time at depth that provides for direct ascent to the surface without decompression stops.

It is a further object of the present invention to provide a device which selects the lesser of the remaining air time at depth or remaining dive time at depth, calculated by the device, that provides for direct ascent to the surface without decompression stops and indicates to the diver the dive time remaining at his current depth that is the minimum of the two calculated time periods.

It is yet another object of the present invention to provide a data sensor, processor, and display for a SCUBA diver that provides the diver with a projection of the combined dive time allowable at various depths prior to his dive.

It is yet a further object of the invention to provide a data sensor, processor, and display for a SCUBA diver which uses a unique mathematical algorithm that has been designed to produce the repetitive dive tables published in the U.S. Navy Diving Manual as a standard to measure each dive profile against to avoid the necessity for decompression during repetitive dives.

It is still another object of the present invention to provide a data processor for a SCUBA diver that displays graphically a time value designated as a "caution zone" which tells the diver when he begins to approach a no-decompression limit during the dive.

And it is still a further object of the present invention to provide a data processor for a diver which records the dive profiles and violations of no-decompression dive limits for subsequent recall and which de-activates the device for the diver's safety for varying periods of time after a violation of the no-decompression dive limits occurs.

Other objects of the present invention will become apparent when the specification of the preferred embodiment is considered in conjunction with the accompanying drawings.

BRIEF DESCRIPTION OF THE DRAWINGS

FIG. 7 is schematic diagram of the electronic circuitry of the preferred embodiment of the present invention;

FIG. 8 is a schematic diagram of the face of the display module in surface mode; and FIG. 9 is another schematic diagram of FIG. 8 in dive mode.

DESCRIPTION OF THE PREFERRED EMBODIMENT

Figure 1:
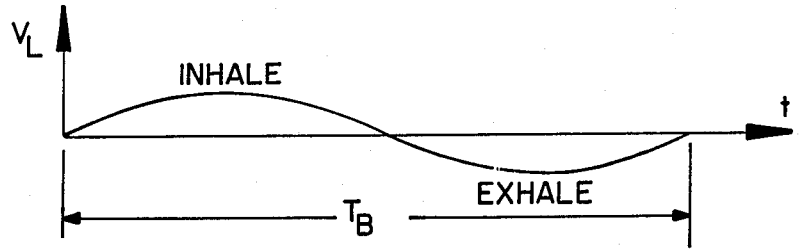
FIG. 1 is a graphical display of a diver's respiration rate.

The present invention is a portable data sensor, processor, and display for use by a SCUBA diver using a tank of compressed air. It is a complex instrument which is connected by a hose to the air tank of the diver, has a digital and graphical display providing information, and is packaged as a single module for the diver's use underwater.

Several different pieces of information are provided for the diver. See FIGS. 8 and 9. One of those pieces of information, the "caution zone", is integrated into a graphic display for easy interpretation by the diver.

DEPTH INDICATOR

The present invention includes a depth display in which the current depth is displayed in large numerals in the lower left portion of the liquid crystal display screen (LCD). The maximum depth attained is shown in the upper left hand corner. Both of these readings display depth in one foot increments up to 250 feet (or in the metric version in meters). Both the depth and maximum depth indicators follow a diver's descent, but once the diver has reached the maximum depth of the dive, the maximum depth reading (MAX) will freeze and only the current depth display will continue to vary unless the MAX is subsequently exceeded in which case the latter or deeper depth will, of course, register on the maximum depth indicator.

TEMPERATURE

An ambient temperature readout is displayed on the LCD to the right of the maximum depth indicator and displays the current temperature in one degree increments from 20° F. to 150° F. The temperature reading will indicate the ambient air temperature if the module is out of the water, and it will commence reading the water temperature once the module is submerged.

TANK PRESSURE

An accurate pressure reading of the air pressure in the tank is displayed at the top center portion of the LCD. It shows tank pressure from zero to 4,000 psi to the nearest 10 psi increment.

DIVE NUMBER

To the right of the tank pressure on the LCD is displayed the dive number. A dive counter function keeps track of how many dives the diver has made. It displays from zero to 9 dives and then recycles back to zero. The counter cycles to the next dive upon descent into the water below 5 feet after a 10 minute surface interval between dives. It resets to zero after a 12 hour surface interval following a no-decompression dive. It resets to zero 24 hours following the last dive of a day that included a de-compression dive.

BOTTOM TIME

The present invention starts to record bottom time at approximately 5 feet on descent and stops at about 3 feet on ascent. This is a more conservative time measurement method than the Navy's method of counting bottom time, which is from the start of the descent to the start of the ascent, and as a result adds to the safety of the diver. Bottom time is shown in hours, minutes, and seconds by small numerals in the upper right hand portion of the LCD.

The second important component of time measurement is surface time which is also displayed in hours and minutes in the lower right hand portion of the LCD up to 19 hours 59 minutes. Initially, when the air valve is turned on, the surface time starts to run. When the diver descends below 10 feet, the surface time display switches to a dive time remaining display. After a dive, the processor delays 15 minutes and then begins counting and displaying surface time at 10 minutes. This affords a 5 minute extra safety margin over the 10 minutes required by the U.S. Navy to distinguish between two dives.

REPETITIVE GROUP DESIGNATION

The present invention keeps track of the diver's no-decompression (NDC) status, and after a dive it will assign the diver a repetitive group designation from the U.S. Navy dive tables. This is displayed in the lower left portion of the LCD after the dive in place of the depth reading.

BATTERY STATUS

The present invention has no knobs or switches to turn it on because it is never off. From the time the batteries are installed until approximately 6,000 hours later, it waits in a "sleep mode" for the diver to hook up to a compressed air tank and turn on the valve. When the module senses more than 50 psi of pressure from the air tank, the display shows the LCD in a fully activated situation for three seconds to indicate that all of the display segments are operating. During this time the device performs a system check including the condition of the battery. If the battery is down to a 15% power reserve, a LOW BAT indication shows on the display. The device will not power up if there is insufficient battery voltage (less than 3%) to complete a dive.

PRE-DIVE PLANNING SEQUENCE

After the power up and systems check has been on for 15 seconds, the device starts the pre-dive planning sequence (PDPS) which provides information about the limitations of the upcoming dive. The device will cycle through depths from 30 to 130 feet and show the minimum available dive times based on the previously recorded breathing rate and the air in the tank, and no-decompression (NDC) limits. The depth and dive time remaining in the PDPs are located in the same positions as during a dive.

AIR DIVE TIME REMAINING

The air remaining factor computation of the dive time remaining display, in the lower right-hand portion of the LCD, is based on a patented algorithm that accurately predicts the air consumption rate of the diver. This is done by continuously monitoring tank pressure versus elapsed time that air is flowing from the tank and obtaining a personal breathing rate parameter. The algorithm provides a read-out that will not vacillate with each breath but is accurate enough to be able to re-evaluate the breathing rate parameter in a time period no greater than sixty seconds. This is important as the breathing rate changes as the diver goes deeper, works harder, or shares air in an emergency situation.

NDC DIVE TIME REMAINING

The NDC (no-decompression) factor computation of the dive time remaining display is based upon the same report that developed the U.S. Navy no-decompression and repetitive dive tables. These tables are used almost universally by divers to plan how long they can stay underwater and avoid decompression sickness. The information contained in this portion of the computer program used in the present invention is in the public domain.

However, there is a problem with the U.S. Navy dive tables because they were made for Navy divers who dive much differently than sport divers. Navy divers usually spend all of thier time at a single working depth on a particular job. Therefore, the tables require that the diver count all his time underwater as spent completely at the maximum depth. This is a very conservative and restrictive way to count time underwater, and it decreases a sport diver's time underwater because he rarely spends most of his time at the deepest depth. Generally sport divers follow the bottom contour and only touch the deepest depth for a small percentage of the length of the dive. Since their tissues are not absorbing all of the extra nitrogen (as is the Navy diver), sport divers are penalized by the tables for descending to the deepest depth when they actually did not spend all of their time there.

The present invention allows for variable depth diving and only penalizes a diver for how long he stays at each particular depth. In this way dive times are greatly increased for the sport diver as compared with using the U.S. Navy dive tables. The accommodation made by the present invention means that the no-decompression (NDC) dive time remaining value will usually increase as the diver ascends from the deeper points of the dive allowing an extended dive time at shallower depths.

DIVE TIME REMAINING DISPLAY

The dive time remaining display on the LCD integrates the air dive time remaining at depth with the no-decompression (NDC) dive time remaining at depth to pick the lesser of the two values and display a time value which tells the diver how much longer he can remain underwater. Since either running out of air or getting into a decompression situation is unacceptable, this function on the display integrates the AIR and NDC factors and displays only the lesser value. This means that if a diver is going to run out of air before getting into decompression, the dive time remaining display will be based on the AIR factor. Conversely, if the diver has plenty of air left and will get into a decompression condition before running out of air, the display will be based on the NDC (no-decompression) factor. The result is that the diver really only needs to know one thing: when to surface. The dive time remaining display tells the diver exactly that. It does not confuse a diver with an array of information showing the status of all of the conditions he is experiencing in order for him to select which condition is the controlling one, but it displays only the more critical information at any moment during the dive.

CAUTION ZONE GRAPHIC DISPLAY

When divers are trained, they are taught not to exceed or to come too close to the no-decompression limit. Therefore, in addition to the dive time remaining display, a caution zone display (CZ) is provided to give the diver a graphic warning of when he is approaching a decompression condition. The graphic display is a segmented portion of a circle, disposed in the center of the LCD, with the center segment being zero time. Ten individual segments are arrayed, or fanned out, on both sides of the zero segment indicating to plus 10 on the right and to minus 10 on the left. To indicate a register on the display, one of the segments alternately reverses color and blanks out and then goes back to normal (i.e. blinks on and off).

The CZ starts to register when the diver reaches ten minutes before the no-decompression limit. In the zone of plus ten minutes degrading to zero, it reads the same information as the NDC dive time remaining display. The difference arises when the diver starts to ascend. Because some tissues in the body stop absorbing nitrogen at shallower depths, the dive time remaining display starts to read that the diver has more time to spend underwater as he ascends. The caution zone display (CZ), however, continues to show that minimum reading, that is, the lowest NDC dive time remaining value that the diver has reached. This minimum reading shows the diver how close he came to the no-decompression limit during the dive. Moreover, it allows each diver to choose their own degree of caution as to how close they want to come to the no-decompression limit, and the CZ allows them to have a visual representation of how close they came to it.

If a diver exceeds the no-decompression limit, he can "make a stop" at ten feet before surfacing to let some of the excess nitrogen out-gas or exit his system. Some divers, however, like to spend time at ten feet even when they have not exceeded the no-decompression limit to add a safety margin in case their physical makeup is not like a Navy diver and they want to be cautious. The caution zone display (CZ) gives credit for time spent at ten feet during the ascent. For every minute spent there, the diver will receive a plus one minute of credit on the CZ. Therefore, if a diver with a plus one on the CZ stays at ten feet for nine minutes, the new CZ reading will flash the plus ten segment and show a steady numerical reading of plus ten below the graphic display.

Since the caution zone display (CZ) shows how close a diver came to the no-decompression limit somewhere during the dive, it is possible for the diver to elect to either make or not make the safety stop based upon his CZ reading. For example, if the CZ is empty, i.e. more than plus ten, he might just surface. But if it reads between plus one and plus ten, he would know that it is a good idea to pause at ten feet to clear the display of the actual condition reading. This allows a diver to choose his own degree of caution.

EMERGENCY DECOMPRESSION

The present invention is not a decompression meter, but rather a no-decompression indicator. However, if the diver does exceed the NDC limit, a procedure is provided to safely bring the diver to the surface so long as he exceeds the NDC limit by less than 10 minutes. If minus 10 is exceeded, the display module violates and shuts down for 24 hours after the diver reaches the surface.

This feature of the caution zone display (CZ) helps the diver get out of trouble if he has inadvertently put himself into a decompression situation. Since the CZ gives one minute of credit for each minute at 10 feet, this holds true if the diver exceeds the NDC limit and goes into a negative value (up to minus 10) in the CZ. The diver who accidentally exceeds the zero limit by some value must immediately proceed to 10 feet and spend enough time there to reach at least zero on the CZ and should stay there until the valve reaches plus 5 or more on the CZ for added safety.

AUTOMATIC SAFETY AFTER DECOMPRESSION

(DECOMPRESSION SAFETY SHUT-OFF)

Most diving instruction authorities strongly suggest that if a diver has done a decompression dive, that they should not go in the water again for 24 hours. The present invention adheres to this rule by shutting off the predictive portions of the display for 24 hours, after the last dive of that day, if a negative value dive has been registered on the caution zone. If a violation of the CZ occurs, by the diver exceeding minus 10 on the display, the CZ flashes −10 and the diver receives no credit on the CZ for decompression stops during the ascent. In effect, the device is stating that it will bring the diver back to the surface safely if he makes a mistake, but that he cannot thereafter use the analytical functions to make another dive for at least one day.

HARDWARE AND PROGRAMS

To gather and monitor the data necessary to make the calculations to activate the display, numerous data input means are provided.

A primary input to the data processor is a first measuring means for measuring the air pressure in the diver's tank and converting it to an electrical voltage output for display on the liquid crystal display screen (LCD). The processor uses this pressure information for calculating air dive time remaining and displays it both as a tank pressure indication and as a dive time remaining if it is the controlling factor in the algorithm which displays dive time remaining. In the preferred embodiment of the present invention it consists of a high pressure rated transducer that is mounted in the display module and is connected to the air tank by a high pressure hose.

A second measuring means for providing data to the processor is a means for measuring ambient hydrostatic pressure and converting it to an electrical voltage output. The information from this sensor is fed into the algorithm and the actual depth is displayed on the LCD. The LCD also has the feature of displaying in the upper left hand portion the maximum depth reached (MAX) by virtue of a memory circuit. In the preferred embodiment of the present invention the means consists of a low pressure rated transducer that is mounted in the display module and is exposed to ambient pressure.

The third measuring device required by the data processor is a means for measuring real time and elapsed time. Two important time recordings are provided by the instrument: bottom time is shown in hours, minutes, and seconds by small numerals in the upper right hand portion of the display, and surface time is displayed in hours and minutes at the lower right hand portion until the diver descends past 5 feet, at which time the display switches to dive time remaining, and the pressure, depth, and time measurements are then integrated into the dive time remaining display. In the preferred embodiment of the invention it consists of a crystal controlled clock that is connected to the microprocessor.

A fourth measuring device is a thermistor located in the display module which measures the ambient temperature of the air or the water.

A dive counter keeps track of how many dives have been made. It displays from zero to 9 dives and then recycles back to zero. The dive counter cycles to the next dive upon descent below 5 feet after a 10 minute surface interval between dives. It re-sets to zero after a 12 hour surface interval after NDC dives. It resets to zero after a 24 hour surface interval after the last dive of a day that included a decompression dive.

There is a repetitive group designation provision which keeps track of the no-decompression dive status. After a dive, it will assign a repetitive group designation to the dive just like the U.S. Navy dive tables and display the designation on the LCD.

Another system monitored by a program is the status of the battery. When the battery is down to a 15% power reserve, a LOW BATT indicator shows on the display. When the battery has less than a 3% power reserve, the unit will not activate.

The data processor includes a first simulating means which is program responsive to the several measuring means for predicting the dive time remaining at depth and that provides for an air reserve following a direct ascent to the surface. This simulating means is described in U.S. Pat. No. 4,586,136 to Lewis for DIGITAL COMPUTER FOR DETERMINING SCUBA DIVING PARAMETERS FOR A PARTICULAR DIVER issued Apr. 29, 1986.

Based on data presented by Bennett and Elliott in *The Physiology and Medicine of Diving* (1975), a SCUBA diver's respiration rate can be characterized by the expired volume of air per unit time $\dot{V}_E$, the tidal volume $V_L$ (the subscript L refers to lung as distinct from tank), the respiratory frequency or equivalently of the breathing period $T_B$. They are related by the formula:

$$\dot{V}_L = \pi \frac{V_L}{T_B} \sin\left(\frac{2\pi t}{T_B}\right), \tag{1}$$

-continued where $$\int_0^{T_B/2} \dot{V}_L \, dt = V_L, \tag{2}$$

$$\dot{V}_E = (\dot{V}_L)_{avg} = \frac{V_L}{T_B}, \tag{3}$$

and t is time (see FIG. 1 of the drawings).

The pressure-volume relationship of the diver's lungs and his tank follow from the ideal gas law, where $$p_T V_T = M_T R T_T \text{ (tank)} \tag{4}$$

$$p_L V_L = M_L R T_L \text{ (lung)}, \tag{5}$$

where p is abolute pressure, V is volume, M is mass, T is absolute temperature, and R is the gas constant for air.

As air is slowly removed from the tank, the temperature will remain nearly constant and $$\dot{p}_T V_T = \dot{M}_T R T_T. \tag{6}$$

Recognizing that the lung pressure is approximately equal to the ambient pressure, a similar relation can be described for the lungs, and $$p_a \dot{V}_L = \dot{M}_L R T_L, \tag{7}$$

where $p_a$ is the ambient pressure. When the diver is inhaling, $$\dot{M}_T = -\dot{M}_L, \tag{8}$$

but when he is exhaling $$\dot{M}_T = 0. \tag{9}$$

Ignoring temperature differences between the tank and the diver's lungs (the ratio of the absolute temperatures will vary less than 10 percent), the relation exists that $$\left.\begin{aligned} \dot{P}_T &= -\pi \cdot p_a \cdot \frac{V_L}{V_T T_B} \cdot \sin\frac{2\pi t}{T_B} && \text{for } \dot{V}_L \geqq 0 \\ &= 0 && \text{for } \dot{V}_L < 0 \end{aligned}\right\} \tag{10}$$

It follows that the average rate of change of tank pressure is $$\overline{\dot{p}_T} = -\frac{P_a}{G}, \tag{11}$$

where g is a breathing rate parameter, and $$G = \frac{V_T T_B}{V_L}. \tag{12}$$

Figure 2:
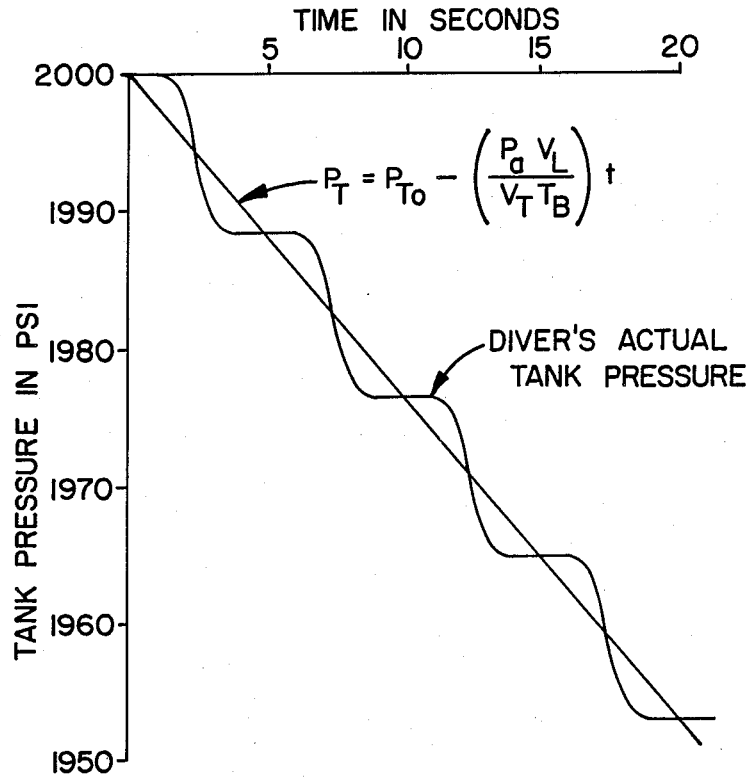
FIG. 2 is a graphical display of a SCUBA diver's air tank discharge.

An example of the tank pressure model is shown in FIG. 2 of the drawings. Conversely, equation (11) can be used to predict the air time remaining, $t_{air}$ that provides for a 300 psi reserve, and $$t_{air} = \frac{G[p_T - 300]}{P_a} - \left(\frac{p_h}{p_a}\right)\frac{D_o}{AR}, \quad (13)$$

where AR is the ascent rate, $p_a$ is the absolute ambient pressure at depth $D_o$ and $p_h$ is the absolute ambient pressure at one half that depth $$p_a = 14.7 + 0.446 D_o \quad (14)$$

$$p_h = 14.7 + 0.446(D_o/2). \quad (15)$$

In order to calculate time remaining a projection must be made and the only way to do that is to look back. The central issue is to evaluate G and for a particular value of $p_a$ which means evaluating $\dot{\overline{p}}_T$. Basically a value of $\Delta p_T/\Delta t$ is needed that is continuously upgraded. If $\Delta p_T$ is too small, large errors will be introduced. On the other hand, if $\Delta p_T$ is too large, the machine will not be "quickly" responsive to changes in a diver's breathing pattern. The design seeks a proper tradeoff between the competing requirements of accuracy and responsiveness.

The machine continuously samples $p_T$. The simplest design requirement is to specify a minimum or critical value $p_c$, and evaluate G only when $\Delta p_T$ has exceeded $p_c$. Then our new estimate of G is $$\hat{G} = \frac{\overline{p_a}}{\Delta p_T} \cdot \Delta t \text{ where } \Delta p_T \geqq p_c, \quad (16)$$

and $\overline{p_a}$ is the average ambient pressure. In order to continuously upgrade the estimate, five additional values of $p_T$ and t need to be stored within this interval. The present design has a critical value $p_c = 2.5\ p_a$.

When the diver is on the surface, and the device is connected to or disconnected from a tank, there will be rapid and large excursions of tank pressure. This design problem is avoided by not allowing $\hat{G}$ to be upgraded when $D < 5$ ft.

The data processor also includes a second simulating means in the form of a program which is responsive to the several measuring means for predicting the dive time remaining at depth and that provides for a direct ascent to the surface without the need for decompression stops.

The no decompression algorithm monitors six nitrogen levels that are governed by the equations $$dN_i/dt = (D - N_i)/T_i \text{ for } D > N_i \; i = 1,6 \quad (17)$$

$$dN_i/dt = 0^* \text{ for } D \leqq N_i \; i = 1,6 \quad (18)$$

where D is the depth in feet of sea water (fsw), t is time in min, $N_i$ is the air equivalent of nitrogen tension in fsw of the (i) th tissue, and $T_i$ is 1/0.693 times the tissue half-time.

The values of $T_i$ and the respective critical nitrogen values (allowable surface values) are listed in Table 1.

TABLE 1

| | |
|---|---|
| $T_1 = 5/.693$ | $NC_1 = 95.7$ |
| $T_2 = 10/.693$ | $NC_2 = 75.0$ |
| $T_3 = 20/.693$ | $NC_3 = 52.4$ |
| $T_4 = 40/.693$ | $NC_4 = 35.043$ |
| $T_5 = 80/.693$ | $NC_5 = 26.25$ |
| $T_6 = 120/.693$ | $NC_6 = 21.6$ |

The design projects nitrogen uptake during a 60 ft/min ascent by reducing the effective critical value by $$NC_i = NC_i(\text{Table 1}) - (D - NC_i)^2/120\ T_i \text{ for } D > NC_i \quad i = 1,6 \quad (19)$$

*The design is rigorously a No Decompression meter. Subsurface nitrogen elimination is not credited.

At any time during a dive, each tissue will have an allowable remaining NDC time, $t_r(i)$. If $D \leqq NC_i$, the time is unlimited. Otherwise, $$t_r(i) = T_i \ln[(D - N_i)/(D - NC_i)] \text{ for } D > NC_i \; i = 1,6 \quad (20)$$

where "ln" refers to a natural logarithm [ln (2) = 0.693].

The allowable remaining NDC time, $t_r$, is the minimum of these six times, i.e., $$t_r = MIN[t_r(i)] \quad (21)$$

For depths greater than 115 ft, dive time is further restricted by the following equation:

$$t_r = t_r(eqn5) - 0.3(D - 115) \text{ for } D > 115 \quad (22)$$

Ten minutes after the diver reaches the surface, a repetitive group assignment is made and his residual nitrogen level $NR_6$ is set at the top of the group as shown in Table 2.

TABLE 2

| Surfacing Value | Group | New Value |
|---|---|---|
| $N_6 \leqq 1$ | A | $NR_6 = 1$ |
| $1 < N_6 \leqq 3$ | B | $NR_6 = 3$ |
| $3 < N_6 \leqq 5$ | C | $NR_6 = 5$ |
| $5 < N_6 \leqq 7$ | D | $NR_6 = 7$ |
| $7 < N_6 \leqq 9$ | E | $NR_6 = 9$ |
| $9 < N_6 \leqq 11$ | F | $NR_6 = 11$ |
| $11 < N_6 \leqq 13$ | G | $NR_6 = 13$ |
| $13 < N_6 \leqq 15$ | H | $NR_6 = 15$ |
| $15 < N_6 \leqq 17$ | I | $NR_6 = 17$ |
| $17 < N_6 \leqq 19$ | J | $NR_6 = 19$ |
| $19 < N_6 \leqq 21$ | K | $NR_6 = 21$ |
| $21 < N_6 \leqq 23$ | L | $NR_6 = 23$ |

If $NR_6$ exceeds 21.6, the diver will have exceeded the NDC limit established in Table 1, and hence "L" is the greatest group that needs to be considered.

After 15 min $NR_6$ is allowed to relax according to the equivalent equations $$NR_6 = NR_6(\text{Initial}) \cdot exp[-(t_s - 15)/T_6[ \quad (23)$$

where $t_s$ is the diver's total surface time, or $$dNR_6/dt = -NR_6/T_6 \quad (24)$$

whichever is easier to calculate. Groups are reassigned according to the schedule listed in Table 2.

For subsequent pre-dive predictions and repetitive dives, $NR_6$ is increased and $t_r$ is decreased as follows:

$$NR_6 = NR_6 + 1 \quad (25)$$

$$t_r = t_r - 1 \quad (26)$$

The other tissues are not tracked when the diver is on the surface, but they are initialized according to the following formulaes:

$$1 - NR_5/D = [1 - (NR_6/D)]^{1.5} \quad (27)$$

$$1-NR_i/D=[1-(NR_{i+1}/D)]^2 i=1,4 \quad (28)$$

These values are used for pre-dive predictions. They represent a literal interpretation of residual nitrogen time that is based solely on the relaxation of the slowest tissue, i.e., the 120 min tissue.

While the diver is on the surface $$N_i=NR_i i=1,6 \quad (29)$$

Once the diver descends below the surface, the original equations (17), (18) are operative, but $N_i$ is never allowed to be less than $NR_i$ that was set when the diver left the surface, $$N_i=MAX[N_i(eqn1), NR_i(D)] \quad (30)$$

Figure 3:
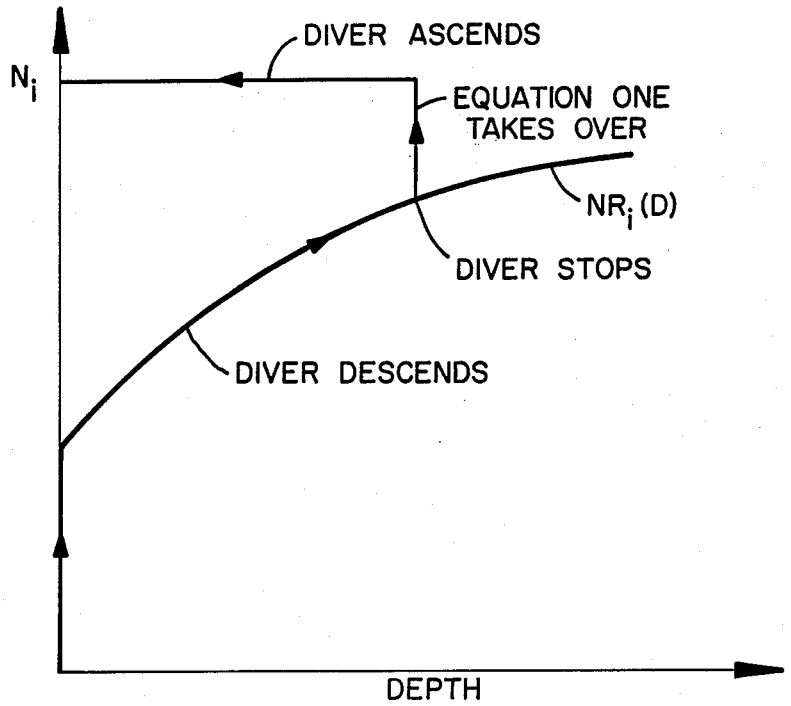
FIG. 3 is a graphical display of a diver's residual nitrogen for a repetitive dive.

So long as his rate of descent is large, $NR_i$ will dominate, but when he slows down or stops at a fixed depth, equation (17) takes over as illustrated in FIG. 3.

The present invention also includes a selection means in the form of a program for determining the allowable remaining dive time which is the lesser of the two dive times predicted by the first and second simulating means. It also includes a means for digitally displaying this allowable remaining dive time.

The data processor of the preferred embodiment also includes a pre-dive planning feature which comprises a simulating means or program for predicting the allowable dive time for a variety of depths prior to a dive along with means for also displaying the information prior to a dive. The same formulas used for predicting dive time available at depth are used to predict dive time available for a variety of depths prior to a dive.

The present invention also includes a measure of decompression status which comprises a means or program for monitoring the minimum no-decompression dive time that occurred during a dive and this is the minimum value of $t_r$ that occurs during a dive. If any value of $N_i$ exceeds $NC_i$ during a dive, all calculations stop and the program counts the time beyond this critical event until the diver reaches 10 ft. and displays this time as negative CZ time. The program monitors the time spent at a depth of approximately 10 feet following a dive and gives the diver one minute of credit for every minute spent at 10 ft. The program adds this time to the minimum no-decompression dive time that occurred during a dive, and this information is displayed on the LCD.

The data processor of the present invention also includes a program for replicating the repetitive dive schedules contained in the U.S. Navy Diving Manual and a program for displaying repetitive dive group status prior to a dive. Table 2 and formulaes 27–30 set forth earlier herein are used for this purpose.

The memory capability of the device records the profile of the last several hundred dives and particularly the decompression and CZ violation dives for subsequent recall. This memory can be accessed by the manufacturer or authorized factory service representative. When CZ violation or decompression dives occur, the penalty provisions of the operating programs are activated to shut down the data processing portions of the device for specified time periods following selected events such as a surface time period or the last dive of a series of dives.

DISPLAY MODULE CONSTRUCTION

Figure 4:
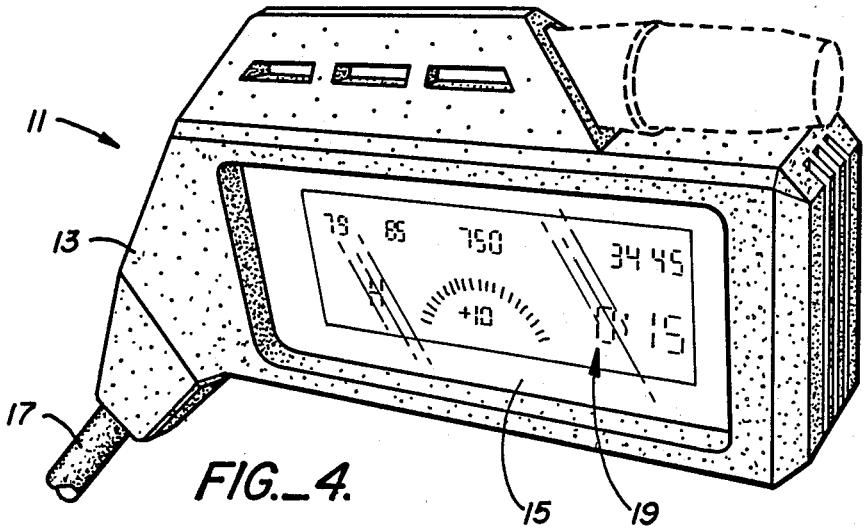
FIG. 4 is a perspective view of the display module of the preferred embodiment of the present invention.

FIG. 4 is a perspective view of preferred embodiment of a device constructed in accordance with the present invention. The display module 11 includes a rubberized cover 13 (not shown in FIG. 4), which is provided for shock protection, and a polycarbonate plastic case 15 which is disposed inside the cover for water tight integrity and encapsulation of the mechanical and electronic components.

The case and rubber cover are designed to hang from an umbilical cord, which is a high pressure hose 17, connecting the display module of the invention to the underwater diver's regulator-air tank assembly (not shown). The display module is designed with a bend at the anterior end to facilitate ergonomic capture by the diver when he is submerged underwater. The design allows immediate viewing at the proper angle without having to bend the wrist into an un-natural position. The rubberized cover also utilizes U.S. Pat. No. 3,888,127 in combining dual back to back instrumentation in one underwater diving instrument console by mounting a compass on the opposite side of the cover from the opening for the liquid crystal display screen.

Figure 5:
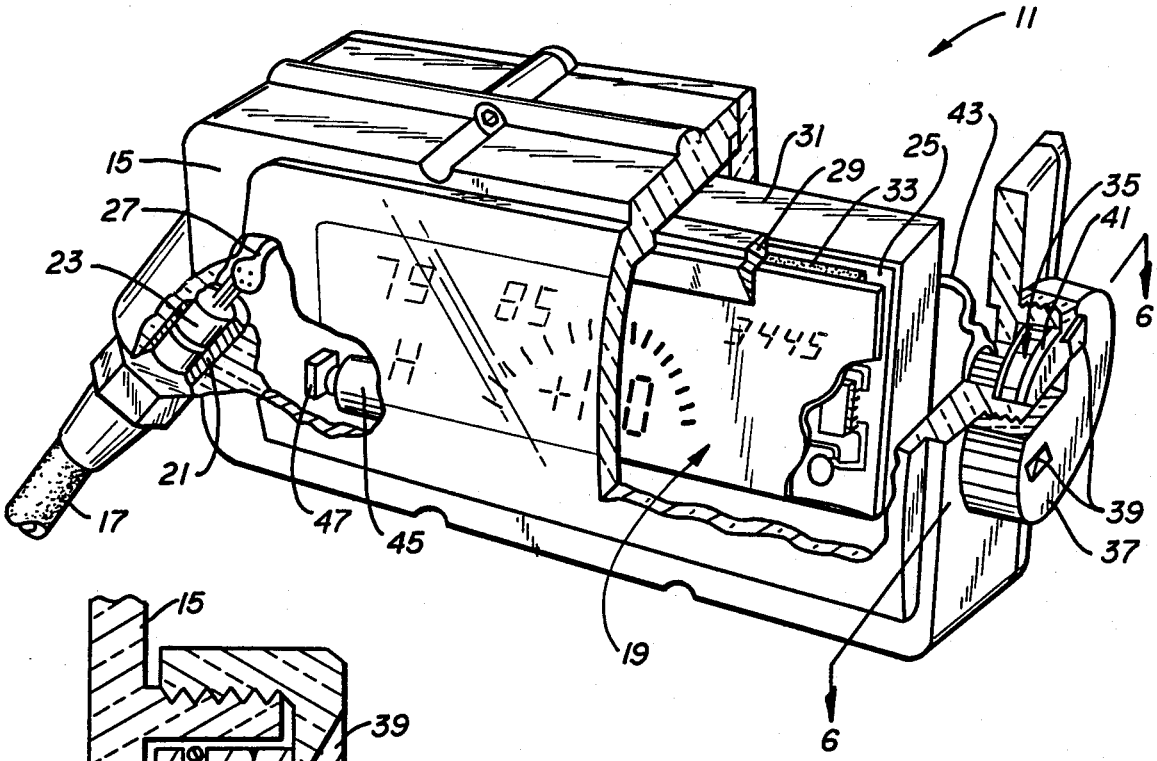
FIG. 5 is a partial section of FIG. 4 with the outside rubberized cover removed.
Figure 6:
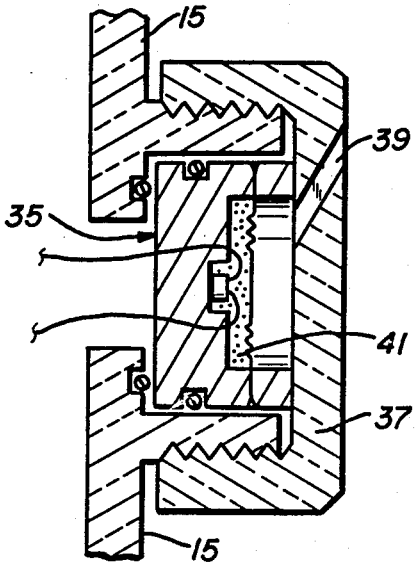
FIG. 6 is a partial section of the low pressure transducer of the present invention.

FIG. 4 shows in the cutaway the essential internal mechanical components. A 4500 psi high pressure hose 17 from the air tank engages the polycarbonate plastic case 15 by means of a metal connector 21 which is an insert molded into the case 15. The insert 21 contains a high pressure piezo-resistive transducer (HPT) 23. The HPT is a constant current, voltage-resistance, bridge circuit which converts pressure to an analog voltage signal and is referenced to near absolute zero pressure (vacuum). The HPT 23 is connected to a printed circuit board (PCB) 25 by means of a flexible circuit conductor 27. The PCB 25 is sandwiched between a plastic bezel 29 and a plastic module backing 31 which holds all other essential components together. The bezel 29 holds the liquid crystal display screen (LCD) 19 which is connected to the PCB 25 by a series of conductive rubber strips 33. The case and cover assembly 13, 15 also contains a low pressure transducer (LPT) 35, at the opposite (distal) end of the module from the hose, which senses the ambient pressure. It is held in place by a plastic retainer cap 37 (see FIG. 5).

The cap 37 is molded from a clear polycarbonate material and has sloped access holes 39 to permit the ambient pressure media to contact the diaphragm of the LPT. The angle of the access holes prevent the incursion of sharp objects which could puncture the LPT diaphragm 41, but allow water to flow freely therethrough. This allows a diver to wash sand out of the cap 37 yet maintain protection of the diaphragm 41 from sharp implements. The openings molded into the rubberized cover 13 permit the diver to visually inspect the diaphragm 41 by looking through the cap 37.

Reference is made to FIG. 7 which shows the block diagram representative of the electronic circuitry of the preferred embodiment of the present invention. The invention utilizes circuitry and standard electronic components which are obvious to one skilled in the art. Complementary metal oxide on silicon (CMOS) technology is used throughout the design in order to maintain low power requirements.

The LPT 35 is connected to the PCB 25 by a flexible circuit connector 43. The unit is powered by two 1.5 volt ½ AA battery cells 45 which make contact with the PCB 25 by means of sheet metal battery clips 47. The PCB includes a number of electronic components which comprise essentially a microcomputer. It is designed around Z-80 central processing unit (CPU) 49 manufactured by Zylog, Inc., two display driver microprocessors (DDM) 51 and 53 manufactured by Sanyo are employed to display the information. These function to interpret and to convert information, as it is processed in the CPU, into graphical and numerical information, and to transmit it to the LCD by means of the conductive rubber strips. One of the DDMs 53 provides a clock (timing function) to provide a reference time base for the CPU 49 and the analog to digital converter circuit (ADC) 55.

The ADC 55 is a CMOS integrated circuit which brings the elements of the microcomputers system together. It has four input channels; one each for each pressure transducer (LPT 35 and HPT 23), one for temperature measurement via a thermistor (an isolated simple circuit - not shown), and one for sensing a battery voltage drop indicating 15% reserve. The ADC 55 is a product of Modulus, Inc. and is designed to be compatible with the requirements for sensing sufficient resolution signal from the HPT 23 and for maintaining unfluctuating indication of pressure on the LCD 19.

Since the essence of the present embodiment is that the system is never "off", then during periods of time exceeding 24 hours, the LCD will be powered down and be blank if no diving activity is taking place (i.e., no air pressure greater than 50 psi is present in hose 17). Once every second the DDM sends a signal to the ADC to power up the HPT and compare its present voltage reading to a stored value greater than that equal to an applied pressure to the high pressure hose of 50 psi. If none is sensed, the unit continues to remain in a power-down mode where only the clock is functioning. If the HPT senses a pressure greater than 50 psi, the ADC in turn signals the CPU to go into the power-up mode. This condition is only present when the SCUBA diver, in preparation for diving, turns on the valve to his tank and regulator which will cause an air pressure greater than 50 psi to be present inside the hose.

Once in the power-up mode, the CPU signals both DDMs to execute a self-check diagnostics program which verifies function and continuity throughout the LCD. The CPU then begins to execute the computational software program stored in the read-only memory (ROM) 57. The full disclosure of all computations executed in the present embodiment are set forth herein and in U.S. Pat. No. 4,586,136. The exact methods and procedural protocol necessary to execute those computations within the present electronic embodiment described herein are obvious to one skilled in the art of programming microcomputers.

The CPU begins execution of the program by autozeroing the LPT signal. This is accomplished as follows: The CPU signals the ADC to power-up the LPT and "read" the ambient pressure in volts. The ADC converts this voltage to digital information and sends it back to the CPU which in turn compares this value to verify that it falls within prescribed limits. Upon verification, this value is then used as the "zero basis" or atmospheric pressure to which all depth information will be based. All depth readings (ambient pressure) will be indicated as feet (ft.) or meters (m) "deep" relative to this zero value. From this point the CPU begins the process of sending data to the DDMs to prepare to display information consistent with existing pressure readings (depth in feet or meters) and a (sequential set) of information indicating predicted dive time available at various depths, temperatures, elapsed time, etc. as previously described.

The entire system then begins to interact with the diving portion of the software upon sensing a changing depth at the LPT. The CPU receives updated information from the ADC every second upon which it calculates present depth, nitrogen tissue loading, present air tank pressure, difference between present and previous tank pressure values, breath rate, caution zone value, air time remaining, no-decompression time remaining, elapsed bottom time, temperature, battery power level status, and maximum depth during present dive. Upon completion of these calculations it in turn sends this information to the DDM's and goes into a power-down mode until one second has elapsed and it is time to receive updated information from the ADC.

During every change in depth of 10 feet, the CPU automatically sends elapsed dive time for the current dive to the random access memory RAM 59 for temporary storage. The RAM is utilized to store certain constants necessary for software calculations and is protected from erasure through a supplemental battery 61.

An external diagnostic access port 63 is provided for calibration and service interrogation when the display module is returned to the factory.

It will be seen from the foregoing description of the preferred embodiment of the present invention that all the objects and advantages claimed herein have been attained. While the apparatus of the present invention is described in considerable detail, many modifications and improvements should be obvious to one skilled in the art. Therefore, the scope of the invention is not to be limited to the details as set forth herein, except as may be necessitated by the appended claims.

I claim:

1. A portable data sensor, processor, and display mounted in a waterproof case for use by a SCUBA diver using a tank of compressed air and for continuously determining during an underwater dive the allowable remaining dive time for the diver comprising said data sensor including at least a means for measuring the air pressure in the tank, a means for measuring the ambient hydrostatic pressure, and a means for measuring time, all of said measuring means mounted in said case and producing data sensor output signals, said processor including at least a first simulating means responsive to said data sensor output signals and arithmetically combining the same for predicting the dive time remaining at depth that provides for an air reserve following an ascent to the surface, and a second simulating means responsive to said data sensor output signals and for arithmetically combining the same and predicting the dive time remaining at depth that provides for a direct ascent to the surface without the need for decompression stops, said time predicted by said second simulating means being the no-decompression dive time limit, said processor including a selection means for determining the allowable remaining dive time which is the lesser of the two dive times predicted by the first and second simulating means, and means for displaying this allowable remaining dive time on said display.

2. The portable device of claim 1 including a graphical visual display of decompression status information comprising, means for monitoring during a dive by a SCUBA diver utilizing said device the allowable remaining dive time and for determining the minimum amount of no-decompression dive time remaining that occurred during a dive, means for monitoring holding time spent at a nitrogen purge depth at the end of a dive and prior to surfacing, means for adding the holding time to the minimum amount of allowable remaining no-decompression dive time that occurred during said dive including negative or decompression dive time, and means for graphically displaying the sum of said times on said display.

3. The portable device of claim 1 including, means for creating and recording the profile of an underwater dive by a SCUBA diver utilizing said device, said profile being the time versus depth experienced by said data sensor during said dive, means for replicating in said processor the repetitive dive schedule data contained in the U.S. Navy Diving Manual, means for comparing in said processor the actual dive profiles of prior underwater dives experienced by the device with said dive schedule data and selecting the repetitive dive group status defined in said Manual that has been experienced by the device during said dives, and means for visually displaying on said display the repetitive dive group status experienced by the device prior to a subsquent underwater excursion by the device.

4. The portable device of claims 1 or 4 including, means for recording underwater dive profiles and violations of no-decompression dive limits for subsequent recall and visual display, and means for automatically de-activating the device for periods of time after violations of no-decompression dive limits have occurred during a dive by a SCUBA diver utilizing said device.

* * * * *